United States Patent [19]

Kruse

[11] 4,181,098

[45] Jan. 1, 1980

[54] HEAT GENERATION BY FRICTIONAL VAPORIZATION

[76] Inventor: Clifford L. Kruse, 326 S. Myrtle, Villa Park, Ill. 60181

[21] Appl. No.: 891,532

[22] Filed: Mar. 30, 1978

[51] Int. Cl.[2] ..... F22B 3/06

[52] U.S. Cl. ..... 122/26; 126/247

[58] Field of Search ..... 122/26; 126/247

[56] References Cited

U.S. PATENT DOCUMENTS

| | | | |
|---|---|---|---|
| 1,975,440 | 10/1934 | Wall et al. | 122/26 |
| 2,226,423 | 12/1940 | Blake | 122/26 |
| 2,764,147 | 9/1956 | Brunner | 122/26 |
| 3,791,349 | 2/1974 | Schaefer | 122/26 |
| 4,060,194 | 11/1977 | Lutz | 122/26 |

*Primary Examiner*—Kenneth W. Sprague

*Attorney, Agent, or Firm*—Hill, Van Santen, Steadman, Chiara & Simpson

[57] ABSTRACT

Method of and means for heat generation by producing vapor i.e., steam, by subjecting liquid to friction of a magnitude to vaporize the liquid in a substantially vertical passage into one end of which the liquid is delivered under pressure and from the opposite end of which the steam is received from the passage for use. Vaporization may be effected as part of a one-way system or of a recirculation system.

22 Claims, 4 Drawing Figures

39
35
19
37
38
28
20
17
24
21
40
7
9
8
11
13
5
12
10
14
15
III
III
27
22
24
18
29
25
33
34
P
41
57
45
49
59
60
55
50
51
54
53
52
22
23
29
22
24
30
31
32
32
24
27
22
48
44
47
42
43
44
58

HEAT GENERATION BY FRICTIONAL VAPORIZATION

This invention relates to heat generation by frictional vaporization, and is more particularly concerned with large volume production of heating vapor.

It is, of course, a well known principle of physics that when a liquid is subjected to friction, it will heat. In some industrial processes friction developed heat in liquid such as oil, and the like, has been a problem alleviated by cooling the liquid before disposal or before recycling.

I am also aware that liquid such as oil or water or other liquid has been subjected to frictional resistance and thereby internal heating for space heating purposes. To the best of my knowledge, however, prior systems have not attained complete or substantially complete vaporization of the liquid for use of the heated vapor for example in high capacity heat transfer systems.

It is therefore an important object of the present invention to provide a new and improved method of and means for heat generation by frictional vaporization.

Another object of the invention is to provide a new and improved method of and means for generating large volume of heated and even super-heated vapor by frictional means.

According to an embodiment of the invention there is provided a method of generating heat by frictional vaporization comprising introducing liquid to be vaporized into one end of a substantially vertically disposed elongate vaporizing passage, within the passage subjecting the liquid to friction of a magnitude to vaporize the liquid as it moves along the passage, and receiving the vapor from the opposite end of said passage.

As a further embodiment of the invention there is provided an apparatus for heat generation by frictional vaporization, comprising a substantially vertically disposed elongate vaporizing passage, means along the length of said passage operating to subject a liquid passing through the passage under pressure to friction of a magnitude to vaporize the liquid, means for supplying the liquid under pressure into one end of said passage, and means for receiving vapor from the opposite end of said passage.

Other objects, features and advantages of the invention will be readily apparent from the following description of a certain representative embodiment thereof, taken in conjunction the the accompanying drawing although variations and modifications may be effected without departing from the spirit and scope of the novel concepts embodied in the disclosure and in which.

Figures 1, 2, 3, 4:
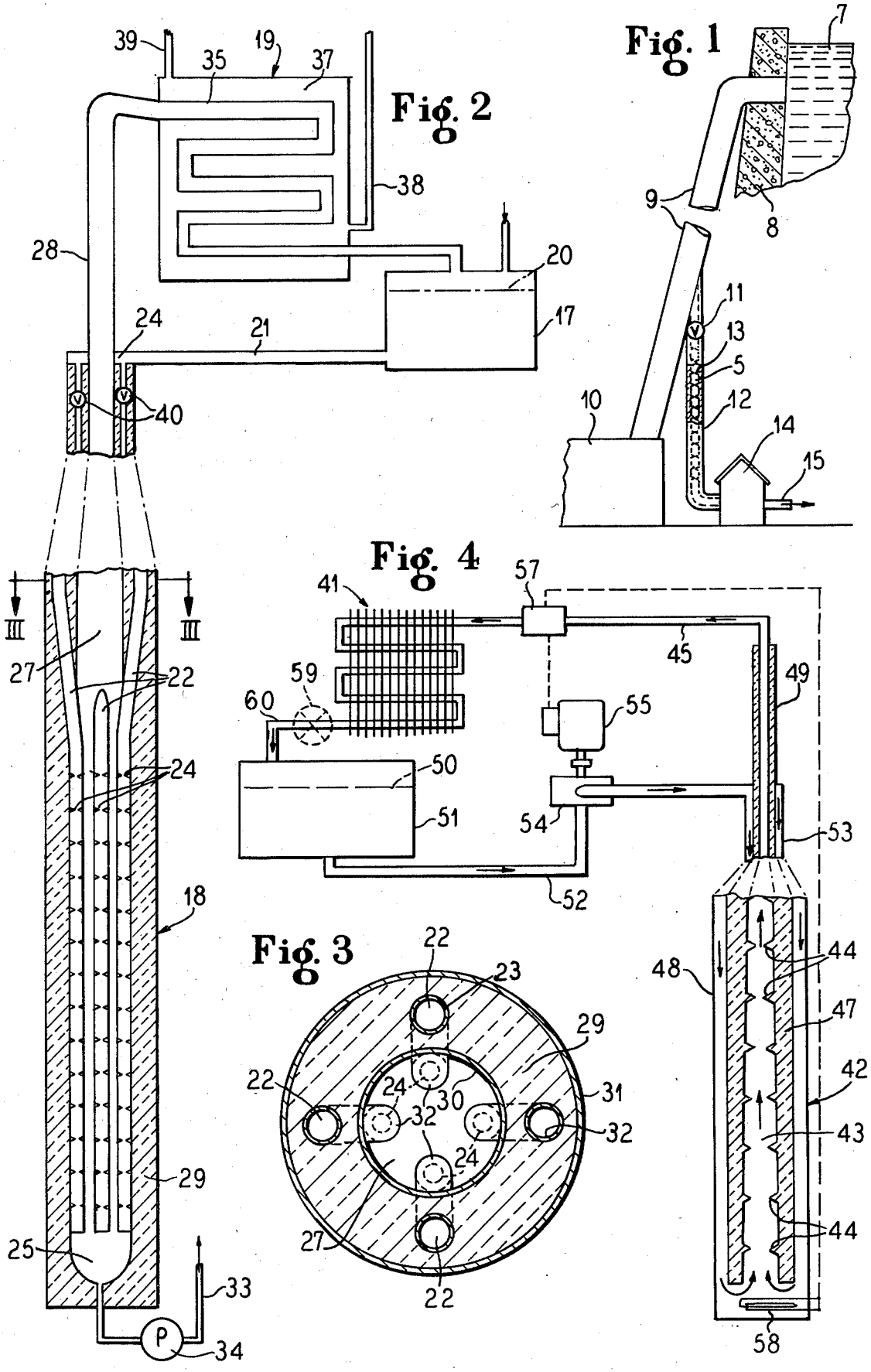
FIG. 1 is a fragmental schematic illustration of one embodiment of the invention.
FIG. 2 is a schematic illustration of another embodiment of the invention.
FIG. 3 is an enlarged sectional detail view taken substantially along the line III—III of FIG. 2.
FIG. 4 is a schematic illustration of still another embodiment of the invention.

On referring to FIG. 1, apparatus for practicing the present invention comprises a substantially vertically disposed elongate vaporizing passage 5 adapted to convert water 7 derived from a reservoir 8 through a flume 9 with which the passage 5 communicates at its upper end at a height sufficient to provide for a gravity drop velocity which will develop ample pressure in the passage 5 for progressive frictional heating and vapor generation depending upon the vapor, i.e., steam, volume desired. For a reservoir supplied system, the passage 5 may be a 1000 or more feet (300m) in length. Although the passage 5 is shown as leading from the flume 9 which may be a hydroelectric flume primarily delivering water to a power house 10, the passage 5 could, of course, be connected directly to the water source in the reservoir 8. To accommodate intermittent steam demand, a control valve 11 may be installed in the upper supply end of the passage 5. This may be a variable valve to control volume of water to descend through the passage 5 as well as to shut off the water supply when there is zero demand. By preference an insulated tube 12 encloses the passage 5 throughout its length.

Means are provided along the passage 5 for subjecting the liquid transiting the passage 5 to progressive vaporizing friction and may comprise the flow restricting surface defining the passage. Transit time for conversion of the liquid to vapor may be shortened by providing frictional vaporization accelerators such as projections 13 along the length of the passage 5 to enhance subjecting of the water to friction of a magnitude to vaporize the water passing through the passage under hydrostatic pressure which may be on the order of 3000 to 4000 psi. In a preferred form, the projections 13 comprise a series of vertically spaced restrictions extending substantially throughout the effective length of the passage 5 and effecting numerous pressure drops so that substantially all of the water is converted to steam as it progresses toward the lower end of the passage 5. By having the passage 5 of sufficient length, relative to cross sectional flow area, the steam may be super heated when it reaches the lower end of the passage. At the lower end of the passage the steam generated in the passage is received by means for utilizing the steam and which may be housed in a factory, power house, dwelling house, or the like 14. Condensate may be run off from the steam heat utilizing means through a waste discharge duct 15.

In contrast to the one-way system of FIG. 1, FIG. 2 depicts a recirculation system in which the liquid is continuously recycled between a liquid supply source such as a tank 17, a friction vapor generator 18 and a use device such as a heat transfer unit 19. Liquid 20 from the tank 17 passes by way of a duct 21 into the upper end of any selected one or more of a plurality of long substantially vertical passages 22 within the generator 18. In this instance four of the passages 22 are shown, but there may be more or fewer of the passages, as preferred consistent with the volume of heated vapor that may be demanded in use of the system. Each of the passages is defined within a tube 23 extending downwardly from a header 24 to which the duct 21 delivers the liquid at a high enough elevation so that high hydrostatic pressure is developed gravitationally in descent of the liquid through the passages 22. Throughout a major length of the passages 22 frictional resistance means desirably comprising a series of vertically spaced restrictions 24 effect numerous pressure drops so that substantially all of the liquid is converted to vapor as it progresses toward the lower ends of the passages 22. Desirably the length of the passages 22, their diameter, and the nature and number of the restrictions 24 are such that by the time the liquid has passed under the hydrostatic pressure a substantial distance down the multi-restricted passage in each instance, the liquid will be sufficiently frictionally heated to become vaporized and then as the vapor is forced on down through the passages the vapor will become superheated. Of course, as the liquid vaporizes, vapor expansion provides substantial back pressure which taken together with the hydrostatic gravity pressure of the liquid enhances vapor pressure and thus heating of the vapor as it progresses downwardly through the final frictional restrictions 24. At their lower ends, the passages 22 discharge into a receiving area or sump 25 at the lower end of a flue 27 which conducts the hot vapor upwardly to a flue extension duct 28 leading to the heat exchanger 19. Thick insulation 29 between a liner 30 defining the flue 27 and an outer protective liner 31 serves to prevent heat disssipation with respect to the flue 27 and the passages 22 which are defined by respective pipes 32. In a preferred construction, upper end portions of the pipes 32 are located within the tubular insulation 29 so as to be separated from the flue 27 and avoid heat transfer from the flue 27 to the upper end portions of the pipes 32 during the initial drop of the liquid through the passages 22 and substantially until the liquid reaches the frictional heating restrictions 24 and by frictional heating and heat transfer through the walls of the pipes 32 to the upwardly traveling vapor in the flue 27 contributes to maintaining the vapor hot even though the vapor may tend to expand to some degree after leaving the passages 22 at the lower end of the flue 27. To maintain sufficient back pressure on the rising column of the heated vapor in the flue 27 the flue extension is preferably of a smaller cross sectional flue area than the flue 27. Any liquid which may at any time in the operation of the system remain unvaporized or condense in the sump area 25, is adapted to be returned to the source of supply, i.e. the tank 17, by way of a return duct 33 which leads from the bottom of the sump and has a scavenger pump 34 to drive the scavenged liquid through the duct 33 and thereby returning the scavenged liquid to the tank 17. Any suitable liquid detecting means may be provided in the sump area 25 for controlling operation of the pump 34 so that the pump operates only when there is liquid in the sump to be scavenged and does not operate to remove vapor from the sump 25 or the flue 27.

On reaching the heat exchanger 19, the vapor passes from the flue extension 28 into a heat exchanger coil 35 which is of progressively diminishing cross sectional flow area to maintain adequate back pressure in the system as the vapor condenses by virtue of heat transfer to a fluid heat transfer medium such as a gas or liquid in a heat transfer chamber 37 within which the heat transfer coil is housed. Heat transfer medium may be delivered to a lower portion of the chamber 37 by way of a duct 38 while heated heat transfer medium is drawn from the top of the chamber 37 through a duct 39.

In order to control the volume of hot vapor generation in accordance with demand, each of the passages 22 is desirably controlled by means of a respective valve 40 adjacent to the manifold 24 so that any one or more of the passages 22 may be selectively closed off during periods of reduced demand and opened as demand increases.

Whereas the frictional vaporization systems of FIGS. 1 and 2 are especially suitable for large volume heated vapor production for industrial and other uses where demand for heat is on a large scale, where smaller volume heating capacity is desired, such as for one or more space vapor, i.e. steam, heating radiators 41, a friction vapor generator 42 may be employed in which frictional vapor generation is adapted to be effected in a shorter column. To this end, the generator 42 comprises a substantially vertical passage 43 into the bottom end of which liquid to be converted into heated vapor is introduced under sufficient pressure to travel up the passage 43 past a succession of frictional restrictions 44. From its lower end to its upper end, the passage 43 progressively diminishes in cross sectional flow area and the restrictive projections 44 form progressively smaller pressure drop ports up the column whereby the liquid is progressively heated until at least by the time the uppermost narrowest restriction is reached the vapor will have been completely heated and vaporized, the hot vapor passing by way of a duct 45 to the heat exchanging radiator 41.

Within the generator 42 the passage 43 is defined within a tubular insulating stack 47, and the liquid may be delivered through the top of a housing shell 48 which encloses the stack 47 in spaced relation. The heat insulation 49 desirably encloses the duct 45 at least for a substantial distance from and beyond the stack 47 and may enclose the duct 45 throughout its length to the radiator 41.

Liquid 50 is supplied to the converter 42 from a receptacle such as a tank 51 from which a supply duct 52 leads to a manifold or inlet 53 at the top of the housing shell 48. Pressure and suitable velocity is imparted to the liquid supplied to the converter by means of a pump 54 driven by means of a motor 55 operated on demand by a suitable control 57 which may be tied into the duct 45 or may be a separate control, as preferred. Thereby the system may be intermittently or ocassionally operated, as may be required. After a period of shutdown, in order to expedite conversion of the liquid to vapor, a preheater 58 may be operated under the entrance into the column 43. Control of the preheater 58 may also be by way of the control device 57.

Condensate from the radiator 41 is returned to the tank 51, thereby establishing a closed system. In order to maintain adequate back pressure in the radiator 41 for effecient operation, a restriction or throttle device 59 is desirably located in a condensate discharge 60 leading from the radiator 41 to the tank 51.

It will be understood that variations and modifications may be effected without departing from the spirit and scope of the novel concepts of this invention.

I claim as my invention:

1. A method of generating heat by frictional vaporization, comprising:

introducing liquid to be vaporized into one end of a substantially vertically disposed elongate vaporizing passage;

causing the liquid to transit from said one end of the passage under substantial hydrostatic pressure and velocity toward the opposite end of the passage;

subjecting the transiting liquid to progressive vaporizing friction of a magnitude to heat and vaporize the liquid as the liquid moves at said pressure and velocity along the passage;

and receiving the hot vapor from said opposite end of said passage.

2. A method according to claim 1, comprising introducing the liquid into the upper end of said passage and causing the liquid to pass downwardly within said passage.

3. A method according to claim 2, comprising introducing the liquid into said upper end of the passage from a reservoir higher than said one end.

4. A method according to claim 2, comprising receiving and returning the hot vapor upwardly from said opposite end of said passage through a flue extending upwardly along but separated from said passage.

5. A method according to claim 2, comprising introducing the liquid to be vaporized into the upper ends of a plurality of substantial vertically disposed elongated vaporizing passages, causing the liquid to pass from the upper ends of all of said passages under substantial pressure toward the lower ends of said passages, subjecting liquid to friction of a magnitude to heat and vaporize the liquid as it moves along all of said passages, and receiving the hot vapor from said lower ends of said passages in a common receiver.

6. A method according to claim 5, comprising removing from the receiver liquid that may fail to be vaporized in said passages.

7. A method according to claim 1, wherein said one end is at the lower extremity of said passage and said opposite end is at the upper extremity of the passage, and driving the liquid under forced pressure into said lower end of the passage.

8. A method according to claim 7, comprising effecting progressively increasing frictional action on the liquid moving under pressure upwardly in said passage and thereby effecting substantially complete heating and vaporization of the liquid by the time it reaches the upper end of the passage.

9. A method according to claim 1, comprising passing the liquid and vapor through a closed circuit system including transferring heat from the vapor and thereby condensing the vapor, and returning the condensate as at least part of the liquid to said one end of the passage for frictional vaporization.

10. A method according to claim 1, comprising preheating said passage at the start of a frictional vaporization operation.

11. Apparatus for heat generation by frictional vaporization, comprising:

means defining a substantially vertically disposed elongate vaporizing passage having length to cross sectional flow ratio adapted for frictional vaporization of liquid forced therethrough under adequate hydrostatic pressure and velocity;

means for supplying liquid to be vaporized under said hydrostatic pressure and velocity into one end of said passage and for maintaining the liquid under said pressure and velocity in transit toward the opposite end of said passage;

friction means along the length of said passage operating to subject said liquid in transit under said hydrostatic pressure and velocity through said passage to friction of a magnitude to heat and vaporize the liquid by the time it reaches said opposite end of said passage;

and means for receiving hot vapor from said opposite end of said passage.

12. Apparatus according to claim 11, wherein said one end of the passage is at the upper end of the passage and said opposite end of the passage is at the lower end of the passage, so that liquid introduced into said upper end of the passage is caused to pass downwardly under said pressure and velocity within said passage.

13. Apparatus according to claim 12, including a reservoir located higher than said upper end of the passage, said upper end of the passage being in communication through said supplying means with said reservoir to receive the liquid therefrom.

14. Apparatus according to claim 12, including a flue extending upwardly along but separated from said passage, and said flue adapted to receive and return the hot vapor upwardly from said lower end of said passage.

15. Apparatus according to claim 12, comprising a plurality of said passages, all of said passages having upper ends, means for introducing said liquid under said pressure velocity into said upper ends of the passages, all of said passages having means therein to subject the liquid to friction of a magnitude to heat and vaporize the liquid as it moves downwardly in said passages, and a common receiver for receiving the hot vapor from said lower ends of said passages.

16. Apparatus according to claim 15, comprising means for removing from said receiver liquid that may fail to be vaporized in said passages.

17. Apparatus according to claim 11, wherein said one end of said passage is at the lower extremity of said passage and said opposite end of the passage is at the upper extremity of the passage, and means for driving the liquid under forced pressure into said lower end of the passage.

18. Apparatus according to claim 17, wherein said means for subjecting the liquid to friction comprises a succession of progressively decreasing flow area restrictions in the upward direction in said passage to effect progressively increasing frictional action on the liquid moving under pressure upwardly in said passage to thereby effect substantially complete heating and vaporization of the liquid by the time it reaches the upper end of the passage.

19. Apparatus according to claim 11, comprising a closed circuit system including heat transfer means receptive of the hot vapor and within which the vapor condenses, and means for returning the condensate as at least part of the liquid to said one end of the passage for frictional vaporization.

20. Apparatus according to claim 11, including means for preheating said passage at the start of a frictional vaporization operation.

21. Apparatus according to claim 11, wherein said friction means comprise a series of vertically spaced frictional resistances for effecting a succession of pressure drops as the liquid progresses under said hydrostatic pressure and velocity along said passage and thereby accelerating frictional conversion of the liquid into vapor.

22. A method according to claim 1, which comprises driving said liquid through a series of vertically spaced frictional restrictions as the liquid progresses along said passage under said hydrostatic pressure and velocity and thereby effecting a succession of pressure drops along said passage and accelerating frictional conversion of the liquid into vapor.

* * * * *

UNITED STATES PATENT AND TRADEMARK OFFICE

CERTIFICATE OF CORRECTION

PATENT NO. : 4,181,098

DATED : January 1, 1980

INVENTOR(S) : Clifford L. Kruse

It is certified that error appears in the above-identified patent and that said Letters Patent are hereby corrected as shown below:

Column 6, line 16, after "pressure" insert --and--

Signed and Sealed this

*Twelfth* Day of *August 1980*

[SEAL]

*Attest:*

SIDNEY A. DIAMOND

*Attesting Officer*

*Commissioner of Patents and Trademarks*